US008539921B2

(12) United States Patent
Kuribayashi et al.

(10) Patent No.: US 8,539,921 B2
(45) Date of Patent: Sep. 24, 2013

(54) SPARK PLUG

(75) Inventors: Makoto Kuribayashi, Aichi (JP); Hirokazu Kurono, Aichi (JP); Toshitaka Honda, Aichi (JP); Tomoaki Kato, Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 363 days.

(21) Appl. No.: 12/921,310

(22) PCT Filed: Mar. 17, 2009

(86) PCT No.: PCT/JP2009/055199

§ 371 (c)(1),
(2), (4) Date: Sep. 7, 2010

(87) PCT Pub. No.: WO2009/116541

PCT Pub. Date: Sep. 24, 2009

(65) Prior Publication Data

US 2011/0000453 A1 Jan. 6, 2011

(30) Foreign Application Priority Data

Mar. 18, 2008 (JP) ..... 2008-069871

(51) Int. Cl.
*H01T 13/20* (2006.01)

(52) U.S. Cl.
USPC ..... 123/169 R; 313/143

(58) Field of Classification Search
USPC ..... 123/169 R; 313/413, 141, 143
See application file for complete search history.

(56) References Cited

U.S. PATENT DOCUMENTS 6,265,816 B1 * 7/2001 Ito et al. ..... 313/141
6,653,768 B2 * 11/2003 Kato et al. ..... 313/143
7,122,948 B2 * 10/2006 Kanao et al. ..... 313/141

(Continued)

FOREIGN PATENT DOCUMENTS

EP 1517418 A2 * 3/2005
JP S61-29085 2/1986

(Continued)

OTHER PUBLICATIONS

International Search Report (English) for PCT/JP2009/055199.

*Primary Examiner* — Stephen K Cronin
*Assistant Examiner* — Elizabeth Hadley
(74) *Attorney, Agent, or Firm* — Stites & Harbison PLLC; Jeffrey A. Haeberlin; Nicolo Davidson

(57) ABSTRACT

An isolation portion (P) of an insulator (10) of a spark plug (100) electrically insulatively isolates a front end portion (22) of a center electrode (20) and a holding portion (56) of a metallic shell (50) from each other and has an intermediate portion (P2) which extends while its outside diameter varies, thereby ensuring an insulation distance between the two portions. The ratio (S/V) of the surface area (S) of the outer surface (14) of the isolation portion (P) to the volume (V) of the isolation portion (P) satisfies the relation $1.26\ mm^{-1} \leqq S/V$, whereby the insulation distance between the front end portion (22) and the holding portion (56) is sufficiently ensured while existing dimensional conditions are held unchanged. Through satisfaction of the relation $S/V \leqq 1.40\ mm^{-1}$, an increase in temperature of the center electrode (20) that accompanies an increase in the amount of heat received from a combustion chamber owing to an increase in the surface area (S) of the outer surface (14) is restrained, thereby maintaining a required heat value.

5 Claims, 8 Drawing Sheets

(56) References Cited

U.S. PATENT DOCUMENTS

| | | | | |
|---|---|---|---|---|
| 7,508,121 | B2 * | 3/2009 | Lykowski | 313/118 |
| 7,703,428 | B2 * | 4/2010 | Nakayama et al. | 123/169 R |
| 7,944,134 | B2 * | 5/2011 | Kyuno et al. | 123/169 R |
| 7,973,459 | B2 * | 7/2011 | Tinwell | 313/141 |
| 2002/0036450 | A1 | 3/2002 | Nishikawa | |
| 2002/0140333 | A1 | 10/2002 | Kato et al. | |
| 2005/0057134 | A1 | 3/2005 | Kanao et al. | |
| 2006/0028108 | A1 | 2/2006 | Okabe et al. | |
| 2007/0216278 | A1 | 9/2007 | Yoshida | |

FOREIGN PATENT DOCUMENTS

| | | |
|---|---|---|
| JP | S50-59428 | 8/1993 |
| JP | 2000-243535 | 9/2000 |
| JP | 2002-56950 | 2/2002 |
| JP | 2002-260817 | 9/2002 |
| JP | 2005-93220 | 4/2005 |
| JP | 2006-49207 | 2/2006 |
| JP | 2007-250258 | 9/2007 |

* cited by examiner

SPARK PLUG

TECHNICAL FIELD

The present invention relates to a spark plug mounted to an internal combustion engine and adapted to ignite an air-fuel mixture.

BACKGROUND ART

Conventionally, spark plugs have been used for ignition in internal combustion engines, such as automobile engines. An ordinary spark plug has a center electrode; an insulator for holding the center electrode in an axial hole thereof; a metallic shell for holding the insulator in a cylindrical hole thereof; and a ground electrode joined to the metallic shell and forming a spark discharge gap in cooperation with the center electrode. The spark plug is mounted to an engine in such a manner as to project the spark discharge gap into a combustion chamber. A spark discharge (initiated through dielectric breakdown of gas and also called an aerial discharge for distinguishing from a creeping discharge to be described later) is generated across the spark discharge gap, thereby igniting an air-fuel mixture.

Meanwhile, the insulator holds the center electrode in a front end portion of the axial hole thereof. The metallic shell holds the insulator such that a holding portion provided in the cylindrical hole thereof is brought in direct or indirect contact with an outer surface of the insulator. The metallic shell and the center electrode are isolated from each other by a portion (hereinafter referred to as the "isolation portion") of the insulator located frontward of a position where the holding portion of the metallic shell is in direct or indirect contact with the insulator, thereby being insulated from each other.

When high voltage is applied between the metallic shell and the center electrode, which are isolated from each other by the isolation portion, a discharge may be generated on the isolation portion in such a manner that sparks creep on a surface of the insulator; i.e., a so-called creeping discharge may be generated on the isolation portion. When a regular spark discharge gap (i.e., a gap between the center electrode and the ground electrode) is widened due to consumption of the electrode(s) or when the spark discharge gap is intentionally widened in the design of a spark plug for enhancement of ignition performance, a required voltage for initiation of an aerial discharge across the spark discharge gap increases. When voltage to be applied across the spark discharge gap is increased so as to meet the requirement, a creeping discharge may be generated along the isolation portion, potentially resulting in an impairment in the reliability of spark discharge across the regular spark discharge gap.

In order to prevent the occurrence of such a creeping discharge, the axial length of the isolation portion may be increased for increasing insulation distance. However, when insulation distance is increased merely through design to axially elongate the isolation portion, the size of the isolation portion increases, resulting in an increase in thermal capacity. Accordingly, the heat transfer performance of the isolation portion may deteriorate. Then, the spark plug is apt to become a spark plug of a low heat value type (a so-called hot type) and thus may fail to satisfy a heat value requirement of an engine. According to conceivable measures for preventing the problem, for example, the isolation portion is provided with an uneven shape; specifically, corrugations, so as to elongate insulation distance against a creeping discharge along the isolation portion while the axial length of the isolation portion is held unchanged. Through employment of such corrugations, the heat value of the spark plug does not change greatly. Also, even when a required voltage for spark discharge increases, a creeping discharge becomes unlikely to be generated, and an aerial discharge can be generated across the regular spark discharge gap (refer to, for example, Patent Document 1).

As mentioned above, the metallic shell holds the insulator such that the holding portion thereof is brought in contact with an outer surface of the insulator. A gap between the holding portion and the isolation portion as measured at a position located frontward of the contact position is narrower than a gap between the wall surface of the cylindrical hole of the metallic shell and the isolation portion. When a large gap is formed between the holding portion and the isolation portion, upon the occurrence of contamination, the generation of sparks across the gap can be restrained. However, in view of a reduction in the size of a spark plug, the employment of such a large gap is difficult. Under the circumstances, when the gap between the holding portion and the isolation portion was reduced to 0.4 mm or less, entry of unburnt gas into the gap could be prevented, and thus resistance to contamination in the gap could be enhanced; as a result, the generation of sparks across the gap could be prevented (refer to, for example, Patent Document 2).

Patent Document 1: Japanese Utility Model Application Laid-Open (kokai) No. S50-59428

Patent Document 2: Japanese Patent Application Laid-Open (kokai) No. 2002-260817

DISCLOSURE OF THE INVENTION

However, in recent years, for enhancement of engine output, pressure within a combustion chamber (compression ratio of air-fuel mixture) tends to be increased above a conventional level. In association with such tendency, a required voltage for spark discharge has been increased further. In the relation between pressure within a combustion chamber and a required voltage for spark discharge, an aerial discharge is known to be higher than a creeping discharge in the magnitude of increase in required voltage with increase in pressure. Thus, when pressure within a combustion chamber is increased above a conventional level, even though insulation distance is elongated through employment of corrugations as in the spark plug of Patent Document 1, a creeping discharge may be apt to be generated. Also, even though contamination in the gap between the holding portion and the isolation portion can be prevented, through application of higher voltage between the electrodes, sparks may be generated across the gap, and the position of the sparks on the isolation portion may serve as a starting point of creeping discharge. In order to prevent this problem, insulation distance against a creeping discharge may be further elongated. However, when, for such elongation of insulation distance, an excessively uneven shape is imparted to the isolation portion, the surface area of the isolation portion increases. Accordingly, the amount of heat received from an engine increases, so that the spark plug is apt to become a spark plug of a low heat value type, potentially resulting in a failure to satisfy a heat value requirement of the engine.

The present invention has been conceived for solving the above-mentioned problems, and an object of the invention is to provide a spark plug which restrains the generation of creeping discharge on an isolation portion of an insulator while satisfying a heat value requirement of an engine and which can reliably generate a spark discharge across a regular spark discharge gap.

A spark plug according to a mode of the present invention comprises a center electrode; an insulator having an axial hole extending in an axial direction of the center electrode, and holding the center electrode in a front end portion of the axial hole; a metallic shell having a cylindrical hole extending in the axial direction, and having, within the cylindrical hole, a holding portion being in direct or indirect contact with an outer surface of the insulator along the whole circumference of the insulator and adapted to hold the insulator in the cylindrical hole; and a ground electrode whose one end portion is joined to the metallic shell and which is bent such that another end portion thereof faces a front end portion of the center electrode and defines a spark discharge gap in cooperation with the front end portion of the center electrode. When a portion of the insulator located, in the axial direction, frontward of a position Q where, as viewed from a front side in the axial direction, the insulator first comes in direct or indirect contact with the holding portion is defined as an isolation portion, a portion of the outer surface of the isolation portion which faces an inwardly oriented surface which partially constitutes the holding portion and faces inward with respect to a radial direction orthogonal to the axial direction is disposed such that a gap of 0.4 mm or less in the radial direction is formed between the portion and the inwardly oriented surface along the whole circumference of the portion. A ratio (S/V) of a surface area S of the outer surface of the isolation portion of the insulator to a volume V of the isolation portion of the insulator satisfies a relation $1.26\ mm^{-1} \leqq S/V \leqq 1.40\ mm^{-1}$. A greatest outside diameter of the isolation portion of the insulator is equal to or less than an outside diameter of the insulator as measured at the position Q.

In the present mode, the gap between the holding portion of the metallic shell and the outer surface of the isolation portion, which isolates the center electrode and the holding portion from each other, is 0.4 mm or less, whereby resistance to contamination is ensured. Further, the ratio (S/V) of the surface area S of the outer surface of the isolation portion of the insulator to the volume V of the isolation portion of the insulator is $1.26\ mm^{-1}$ or higher; thus, a sufficient insulation distance can be ensured for preventing the generation of creeping discharge along the isolation portion. Accordingly, even when the combustion pressure is increased for implementation of high output of an engine, and thus a required voltage for spark discharge is increased, a spark discharge can be reliably generated across a regular spark discharge gap. On the other hand, an increase in the surface area S accompanies an increase in the amount of heat received from a combustion chamber. However, since S/V is $1.40\ mm^{-1}$ or less, an increase in temperature of the center electrode can be restrained, whereby a required heat value can be maintained. Accordingly, the size of a spark plug can be reduced while a conventional dimensional ratio is maintained. Therefore, the present mode is favorable for a reduction in size of and an increase in output of an engine.

Meanwhile, the ratio (S/V) of the surface area S of the outer surface of the isolation portion of the insulator to the volume V of the isolation portion of the insulator can readily satisfy the above-mentioned range through, for example, impartation of an uneven shape to the isolation portion. In impartation of such a shape, by means of limiting the greatest outside diameter of the isolation portion of the insulator to not greater than the outside diameter of the insulator as measured at the position Q, the approach of the isolation portion to the wall surface of the cylindrical hole of the metallic shell can be limited. Therefore, the generation of aerial discharge between the isolation portion and the wall surface of the cylindrical hole of the metallic shell (so-called side sparks) can be prevented.

In the spark plug according to the present mode, a front end portion in the axial direction of the isolation portion may project 1.0 mm or more from a front end of the metallic shell. Also, in the outer surface of the front end portion of the isolation portion, a dihedral angle portion defined by a front end surface and an outer side surface may be rounded with a radiusing dimension of 0.4 mm or less. A distance in the radial direction between the center electrode and a wall surface of the axial hole of the insulator as measured at the front end portion of the isolation portion may be 0.05 mm or greater.

A dihedral angle region defined by the front end surface of the metallic shell and the wall surface of the cylindrical hole of the metallic shell is the location where the electric field strength is apt to increase. Thus, a portion of the outer surface of the insulator located near the dihedral angle region of the metallic shell is apt to serve as a starting point of aerial discharge (lateral sparks) between the portion and the dihedral angle region. Upon occurrence of lateral sparks, a creeping discharge which creeps on the outer surface of the insulator is generated between the starting point and the center electrode. Thus, by means of the front end portion of the isolation portion projecting 1.0 mm or more from the front end of the metallic shell, the insulation distance along the creeping discharge path can be elongated, whereby the insulation resistance between the dihedral angle region and the center electrode can be further increased. Accordingly, when the spark plug according to the present mode is used in an engine whose output is further enhanced, the spark plug can exhibit sufficient insulation performance, so that the generation of lateral sparks can be effectively prevented.

In a process of manufacturing a spark plug, a dihedral angle portion defined by the front end surface of the front end portion of the isolation portion and the outer side surface of the front end portion may be apt to be chipped. In order to prevent such chipping, the dihedral angle portion may be rounded. Nevertheless, the greater the radiusing dimension, the shorter the insulation distance at the rounded portion. In order to use the spark plug according to the present mode in an engine whose output is further enhanced, the employment of a radiusing dimension of 0.4 mm or less is a good practice for ensuring sufficient insulation distance.

By means of forming a gap between the center electrode and a wall surface of the axial hole of the insulator at the front end portion of the isolation portion, an air layer in the gap yields an insulation effect and ensures the insulation distance between the metallic shell and the center electrode. In order for the spark plug according to the prevent mode to exhibit sufficient insulation performance in use with an engine whose output is further enhanced, it is good practice to employ a radial distance of 0.05 mm or greater between the center electrode and a wall surface of the axial hole of the insulator.

In the spark plug according to the present mode, the front end portion of the isolation portion may assume a cylindrical shape extending in the axial direction and may be disposed in such a manner as to extend in the axial direction beyond a position of the front end of the metallic shell. A ratio (S/V) of the surface area S of the front end portion of the isolation portion to the volume V of the front end portion of the isolation portion may satisfy a relation $1.40\ mm^{-1} S/V \leqq 2.00\ mm^{-1}$. By means of disposing the cylindrical front end portion of the isolation portion in such a manner as to extend in the axial direction beyond the position of the front end of the metallic shell, a distance can be ensured between the outer surface of the insulator and the metallic shell's dihedral angle region, where the electric field strength is apt to increase. Thus, the generation of lateral sparks can be prevented.

In order to reliably ensure an insulation distance at the front end portion of the isolation portion, as mentioned above, it is good practice to provide for the ratio (S/V) of the surface area S of the front end portion of the isolation portion of the insulator to the volume V of the front end portion; specifically, S/V is determined so as to satisfy the relation $1.40\ mm^{-1} \leqq S/V \leqq 2.00\ mm^{-1}$. Even when S/V at the front end portion of the isolation portion is less than $1.40\ mm^{-1}$, sufficient insulation distance can be ensured for practical use. However, in order to ensure reliable insulation distance at the front end portion of the isolation portion even when a required voltage is increased to cope with a further increase in output of an engine, it is good practice to employ an S/V at the front end portion of the isolation portion of $1.40\ mm^{-1}$ or higher. When S/V at the front end portion of the isolation portion increases, the amount of heat which the front end portion of the isolation portion receives from a combustion chamber increases, leading to an increase in temperature of the center electrode. Thus, it is good practice to employ an S/V of $2.00\ mm^{-1}$ or less at the front end portion of the isolation portion.

In the spark plug according to the present mode, the metallic shell may have an attachment portion formed on an outer circumference thereof and having threads for attaching the metallic shell to an internal combustion engine. Preferably, a nominal diameter of the threads is M8 to M12. Preferably, a shortest distance L in the radial direction between the outer surface of the isolation portion of the insulator and a dihedral angle region defined by a front end surface of the metallic shell and a wall surface of the cylindrical hole of the metallic shell is greater than a size G of the spark discharge gap.

By means of rendering the shortest distance L between the dihedral angle region of the metallic shell and the outer surface of the isolation portion of the insulator greater than the size G of the spark discharge gap, there can be prevented the generation of lateral sparks starting from the dihedral angle region, where the electric field strength is apt to increase. Thus, a spark discharge can be reliably generated across a regular spark discharge gap. Even when the size of a spark plug is reduced while a conventional dimensional ratio is maintained, through application of the present invention, the generation of lateral sparks and a creeping discharge can be prevented. Thus, application of the present invention to a spark plug in which the threads of the attachment portion of the metallic shell have a nominal diameter of M8 to M12 is preferred in view of simultaneous implementation of a reduction in size of an engine and high output of the engine.

In the spark plug according to the present mode, a smallest thickness T of the isolation portion of the insulator as measured in the radial direction may be 0.5 mm or greater. In increasing the surface area S of the outer surface of the isolation portion of the insulator, through employment of a smallest thickness T of the isolation portion of the insulator of 0.5 mm or greater as in the present mode, an insulator workpiece can exhibit sufficient strength against handling in a process of manufacturing the insulator, so that the occurrence of a problem, such as breakage, can be restrained.

The spark plug according to the present mode may be characterized in that the difference between a greatest outside diameter of the isolation portion of the insulator and the diameter of the cylindrical hole of the metallic shell is 0.5 mm or greater in terms of radius difference.

BEST MODE FOR CARRYING OUT THE INVENTION

A spark plug according to an embodiment of the present invention will next be described with reference to the drawings. In the following description, the direction of an axis O of a spark plug 100 in FIG. 1 is referred to as the vertical direction, and the lower side of the spark plug 100 in FIG. 1 is referred to as the front side of the spark plug 100, and the upper side as the rear side of the spark plug 100.

Figure 1:
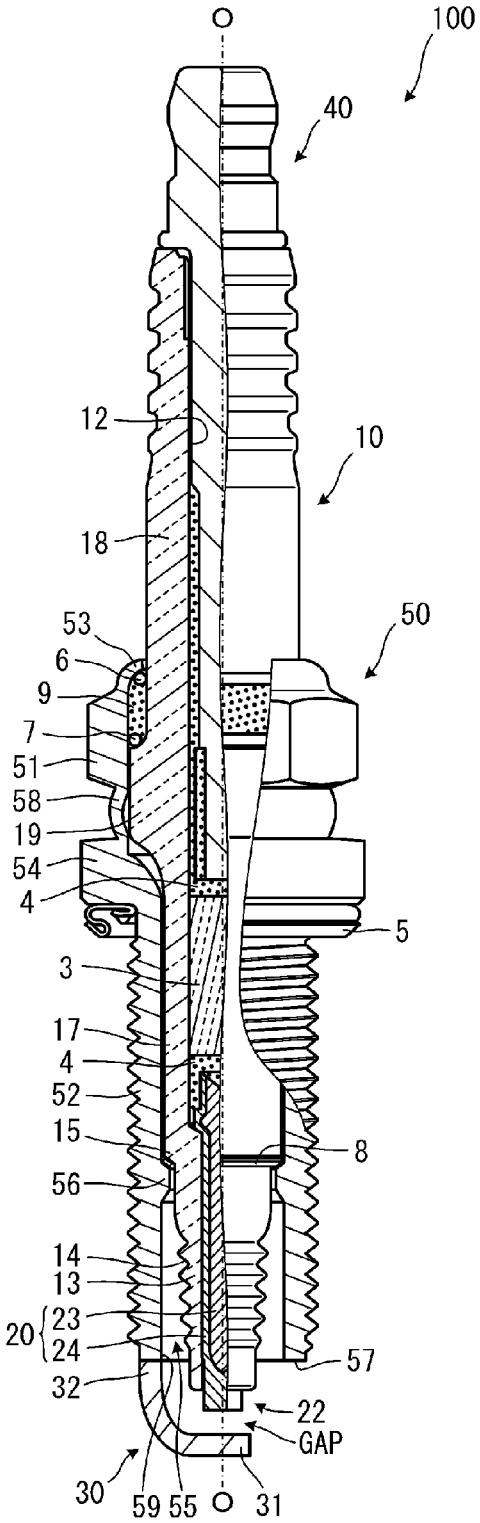
FIG. 1 Partially sectional view of a spark plug 100.

As shown in FIG. 1, the spark plug 100 is composed substantially of a center electrode 20; an insulator 10 holding the center electrode in an axial hole 12 thereof; a metallic shell 50 holding the insulator 10 in a cylindrical hole 55 thereof; a ground electrode 30 joined to the metallic shell 50 and defining a spark discharge gap GAP in cooperation with the center electrode 20; and a metal terminal 40 provided at a rear end portion of the insulator 10.

First, the insulator 10 will be described. As is well known, the insulator 10 is formed through firing of alumina or the like and has a tubular shape such that the axial hole 12 extending in the direction of the axis O is formed at the axial center. The insulator 10 has a flange portion 19 formed substantially at the center with respect to the direction of the axis O and having the largest outside diameter, and a rear trunk portion 18 located rearward (on the upper side in FIG. 1) of the flange portion 19. The insulator 10 further has a front trunk portion 17 located frontward (on the lower side in FIG. 1) of the flange portion 19 and having an outside diameter smaller than that of the rear trunk portion 18, and a leg portion 13 located frontward of the front trunk portion 17 and having an outside diameter smaller than that of the front trunk portion 17. The leg portion 13 reduces in diameter toward the front end thereof. When the spark plug 100 is attached to an engine head (not shown) of an internal combustion engine, the leg portion 13 is exposed to a combustion chamber. A portion between the leg portion 13 and the front trunk portion 17 is formed in a stepped manner for allowing the metallic shell 50 to hold the insulator 10 in a cylindrical hole 55, which will be described later, and for maintaining gastightness. In the present embodiment, the portion is called a stepped portion 15. As will be described later, in the present embodiment, at the leg portion 13, an outer surface 14 of the insulator 10 has unevenness.

Next, the center electrode 20 is a rodlike electrode and has a structure in which a base metal 24 of a nickel alloy, such as INCONEL 600 or 601 (trademark), internally has a metal core 23 formed from copper or the like superior in thermal conductivity to the base metal 24. The center electrode 20 is held in a front end portion of the axial hole 12 of the insulator 10. A front end portion 22 of the center electrode 20 projects from the front end of the insulator 10 and defines the spark discharge gap GAP in cooperation with a front end portion 31 of the ground electrode 30, which will be described later. The center electrode 20 is electrically connected to the metal terminal 40 located rearward (on the upper side in FIG. 1) via a seal body 4 and a ceramic resistor 3, which are provided within the axial hole 12. A high-voltage cable (not shown) is connected to the metal terminal 40 via a plug cap (not shown) for application of high voltage for spark discharge.

Next, the ground electrode 30 will be described. The ground electrode 30 is formed from a metal having high corrosion resistance. An example of such a metal is a nickel alloy, such as INCONEL 600 or 601 (trademark). The ground electrode 30 has a substantially rectangular cross section taken perpendicularly to the longitudinal direction thereof and is connected, at a proximal end portion 32, to a front end surface 57 of the metallic shell 50. The ground electrode 30 is bent such that a distal end portion 31 thereof faces the front end portion 22 of the center electrode 20 and defines the spark discharge gap GAP in cooperation with the front end portion 22 of the center electrode 20.

Next, the metallic shell 50 will be described. The metallic shell 50 is a cylindrical metal member for fixing the spark plug 100 to an engine head (not shown) of an internal combustion engine. The metallic shell 50 holds the insulator 10 in the cylindrical hole 55 in such a manner as to surround a region of the insulator 10 extending from a portion of the rear trunk portion 18 to the leg portion 13. The metallic shell 50 is formed from a low-carbon steel and has a tool engagement portion 51 to which an unillustrated spark plug wrench is fitted, and an attachment portion 52 on which threads are formed for screw engagement with a threaded hole (not shown) formed in the engine head.

The metallic shell 50 has a flange-like seal portion 54 formed between the tool engagement portion 51 and the attachment portion 52. An annular gasket 5 formed through bending of a sheet body is disposed through fitting on the outer circumferential surface of a portion located between the attachment portion 52 and the seal portion 54. When the spark plug 100 is mounted in a mounting hole (not shown) formed in an engine head, the gasket 5 is crushed and deformed between the seal portion 54 and the periphery of an opening of the mounting hole, thereby sealing against them and thus preventing leakage of gas from a combustion chamber through the mounting hole.

The metallic shell 50 has a holding portion 56 provided along the whole inner circumference thereof at a position corresponding to the attachment portion 52. The holding portion 56 projects radially inward from a wall surface 59 of the cylindrical hole 55. The stepped portion 15 of the insulator 10 is held on the holding portion 56 via an annular sheet packing 8. The metallic shell 50 has a thin-walled crimp portion 53 located rearward of the tool engagement portion 51, as well as a buckle portion 58 thin-walled similar to the crimp portion 53 and located between the seal portion 54 and the tool engagement portion 51. Annular ring members 6 and 7 are disposed in a space between the outer surface 14 of the rear trunk portion 18 of the insulator 10 and a portion of the wall surface 59 of the cylindrical hole 55 of the metallic shell 50 ranging from the tool engagement portion 51 to the crimp portion 53. A space between the ring members 6 and 7 is filled with a powder of talc 9. When the crimp portion 53 of the metallic shell 50 is bent inward for crimping, the insulator 10 is pressed frontward in the cylindrical hole 55 and is thus supported between the crimp portion 53 and the holding portion 56, thereby being united with the metallic shell 50. At this time, gastightness of the junction between the metallic shell 50 and the insulator 10 is maintained by means of the sheet packing 8 intervening between the holding portion 56 and the stepped portion 15, thereby preventing outflow of combustion gas. The buckle portion 58 is configured to be outwardly deformed in association with application of compressive force in a crimping process, thereby increasing the stroke of compression of the talc 9 along the direction of the axis O and thus enhancing gastightness of the interior of the metallic shell 50.

The thus-configured spark plug 100 according to the present embodiment has a structure for restraining the generation of creeping discharge which creeps on the outer surface 14 of the insulator 10, in order to reliably generate a spark discharge across the spark discharge gap GAP at the timing of spark discharge. The configuration of the insulator 10 will next be described with reference to FIG. 2.

Figure 2:
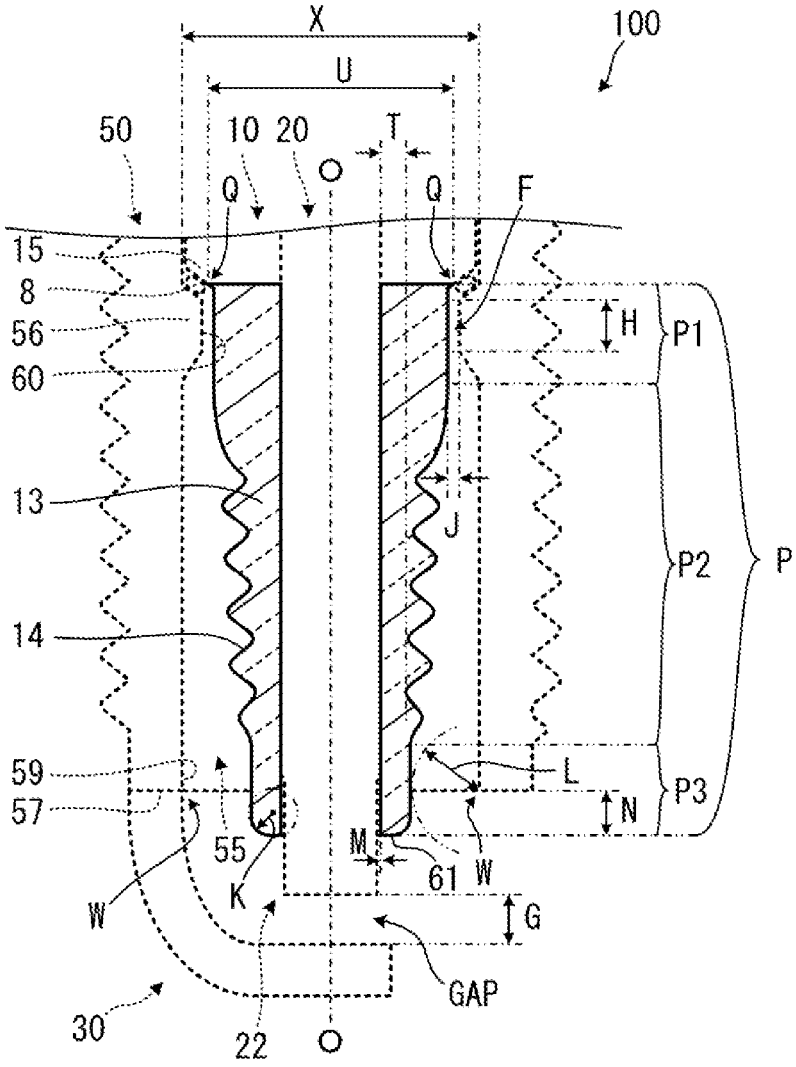
FIG. 2 Enlarged sectional view of an isolation portion P of the spark plug 100.

As mentioned previously, the leg portion 13 of the insulator 10 shown in FIG. 2 is located frontward of the stepped portion 15, through which the metallic shell 50 holds the insulator 10. The stepped portion 15 is held on the holding portion 56 of the metallic shell 50 via the sheet packing 8. In other words, the holding portion 56 of the metallic shell 50 is in indirect contact with the stepped portion 15 of the insulator 10 via the sheet packing 8, thereby holding the insulator 10. In the present embodiment, on a portion of the outer surface 14 of the insulator 10 at which the sheet packing 8 is in contact with the stepped portion 15, a position located most frontward in the direction of the axis O is called a position Q. A portion of the insulator 10 located frontward of the position Q in the direction of the axis O and adapted to electrically insulatively isolate the center electrode 20 and the holding portion 56 from each other is called an isolation portion P. Specifically, in FIG. 2, the isolation portion P of the insulator 10 is represented by the solid line.

In the course of operation of the spark plug 100, high voltage is applied between the metallic shell 50 and the metal terminal 40 (see FIG. 1). A spark discharge (aerial discharge) is generated across the spark discharge gap GAP between the ground electrode 30 joined to the metallic shell 50 and the center electrode 20 electrically connected to the metal terminal 40, thereby igniting an air-fuel mixture. At this time, high voltage is applied between the metallic shell 50 and the center electrode 20. Thus, in order to avoid the generation of spark discharge between the center electrode 20 and the metallic shell 50 (holding portion 56), which could otherwise result from the generation of creeping discharge on the isolation portion P intervening between the center electrode 20 and the metallic shell 50, sufficient insulation distance must be provided therebetween. Further, in order to reliably generate a spark discharge (aerial discharge) across the spark discharge gap GAP even in a state in which the pressure in a combustion chamber is increased above a conventional level, desirably, not only is the distance along the surface of the isolation portion P between the metallic shell 50 and the center electrode 20 increased, but also the surface area of the outer surface 14 of the isolation portion P of the insulator 10 is increased.

In order to achieve the above increase in surface area, in the spark plug 100 according to the present embodiment, for example, unevenness is imparted to the outer surface 14 of the isolation portion P of the insulator 10. Mere impartment of unevenness to the isolation portion P is insufficient. In order to reliably prevent the generation of creeping discharge along the isolation portion P while a heat value requirement of an engine is satisfied, the following various provisions are made.

First, as shown in FIG. 2, in the isolation portion P of the insulator 10, a portion which faces the holding portion 56 of the metallic shell 50 in a radial direction (direction orthogonal to the axis O) is called a proximal end portion P1. In the present embodiment, the proximal end portion P1 assumes a cylindrical shape and extends in the direction of the axis O with substantially the same outside diameter. A portion of the isolation portion P which extends frontward from the proximal end portion P1 in the direction of the axis O while the outside diameter thereof changes is called an intermediate portion P2. As mentioned above, in the present embodiment, unevenness is imparted to the outer surface 14 of the intermediate portion P2 of the insulator 10. Further, a portion of the isolation portion P which extends frontward from the intermediate portion P2 in the direction of the axis O is called a front end portion P3. Similar to the proximal end portion P1, the front end portion P3 assumes a cylindrical shape and extends in the direction of the axis O. A front end surface 61 of the front end portion P3 is located, in the direction of the axis O, frontward of the front end surface 57 of the metallic shell 50.

At the proximal end portion P1, the outer surface 14 has a portion F which faces an inwardly oriented surface 60 which partially constitutes the holding portion 56 and faces radially inward. A gap J is present between the portion F and the inwardly oriented surface 60. The size (outside diameter) of the proximal end portion P1 is set such that the size (radial length) of the gap J is 0.4 mm or less along the whole circumference of the portion F. When the gap J is greater than 0.4 mm, in the course of operation of an internal combustion engine, unburnt gas may enter the gap J, potentially resulting in accumulation of contaminant in the gap J. When, as a result of growth of a layer of accumulated contaminant, the inwardly oriented surface 60 of the holding portion 56 and the outer surface 14 of the portion F of the insulator 10 come in electrical contact with each other via the contaminant, the insulation resistance between the metallic shell 50 and the center electrode 20 lowers; thus, a creeping discharge along the isolation portion P may be apt to be generated. In order to ensure insulation resistance against aerial discharge between the inwardly oriented surface 60 of the holding portion 56 and the outer surface 14 of the portion F of the insulator 10, the gap J is desirably 0.05 mm or greater, more desirably 0.2 mm or greater.

When H represents a length in the direction of the axis O along which the inwardly oriented surface 60 of the holding portion 56 and the outer surface 14 of the portion F of the insulator 10 extend while defining the gap J therebetween, it is good practice to ensure a length H of 0.5 mm or greater. When the length H is less than 0.5 mm, effective prevention of entry of unburnt gas into the gap J becomes difficult. Meanwhile, as the length H increases, the opening of the gap J is shifted more frontward in the direction of the axis O within the cylindrical hole 55 of the metallic shell 50. Then, an insulation distance against a creeping discharge along the isolation portion P as measured from the vicinity of the opening of the gap J is decreased. Accordingly, when a contaminant adheres to the vicinity of the opening of the gap J, sparks may be generated via the contaminant. Therefore, the length H is desirably 2.5 mm or less.

By means of providing for the gap J as mentioned above, contamination resistance is enhanced as mentioned above. However, insulation resistance against aerial discharge is lowered. Thus, by means of providing for the ratio (S/V) of the surface area S of the isolation portion P of the insulator 10 to the volume V of the isolation portion P of the insulator 10, an insulation distance against creeping discharge along the isolation portion P is ensured. Specifically, there is made the provision that S/V satisfy the relation $1.26\ mm^{-1} \leqq S/V \leqq 1.40\ mm^{-1}$. When the ratio (S/V) of the surface area S of the isolation portion P of the insulator 10 to the volume V of the isolation portion P of the insulator 10 is less than $1.26\ mm^{-1}$, the isolation portion P fails to have sufficiently large surface area S, potentially resulting in a failure to ensure sufficient insulation distance against creeping discharge along the isolation portion P between the metallic shell 50 and the center electrode 20. Meanwhile, an increase in the ratio of the surface area S of the isolation portion P to the volume V of the isolation portion P means that the surface area S of the isolation portion P of the insulator 10 increases as compared with a spark plug having an equivalent size, and is thus accompanied by an increase in heat received from a combustion chamber. Specifically, when S/V is in excess of $1.40\ mm^{-1}$, the temperature of the center electrode 20 increases greatly due to heat received from the isolation portion P. Thus, the spark plug 100 becomes a spark plug of a low heat value type (a so-called hot type), potentially resulting in a failure to satisfy a heat value requirement of an engine.

As seen from the above, through employment of the provision that the ratio (S/V) of the surface area S of the isolation portion P of the insulator 10 to the volume V of the isolation portion P of the insulator 10 satisfy the relation $1.26\ mm^{-1} \leqq S/V \leqq 1.40\ mm^{-1}$, a spark plug whose size is reduced while a conventional dimensional ratio is maintained can be used with an engine having high combustion pressure. That is, in contrast to elongation of the leg portion in the direction of the axis O for ensuring insulation distance between the center electrode and the holding portion of the metallic shell, through application of the present invention to design of a spark plug, even when the spark plug size is reduced while a conventional dimensional ratio is maintained, sufficient insulation distance can be ensured between the center electrode and the holding portion of the metallic shell. Specifically, application of the present invention to the spark plug 100 in which the threads of the attachment portion 52 of the metallic shell 50 have a nominal diameter of M8 to M12 is preferred in view of simultaneous implementation of a reduction in size of an engine and high output of the engine.

Further, the spark plug 100 employs the provision that the greatest outside diameter of the isolation portion P of the insulator 10 be equal to or less than an outside diameter U of the insulator 10 as measured at the position Q. In the present embodiment, since the intermediate portion P2 of the isolation portion P is reduced in diameter frontward while assuming unevenness, a position where the isolation portion P of the insulator 10 assumes a greatest outside diameter coincides with the position Q. Even otherwise, by virtue of the provision, the isolation portion P does not project radially outward beyond the outside diameter U of the insulator 10 as measured at the position Q. Accordingly, in increasing the surface area S of the outer surface 14 of the isolation portion P of the insulator 10, the approach of the isolation portion P to the wall surface 59 of the cylindrical hole 55 of the metallic shell 50 can be limited. Therefore, the generation of aerial discharge between the isolation portion P and the wall surface 59 of the cylindrical hole 55 (so-called lateral sparks) can be prevented. More preferably, the difference between a diameter X of the cylindrical hole 55 of the metallic shell 50 and the greatest outside diameter of the isolation portion P of the insulator 10 is 1.0 mm or greater (0.5 mm or greater in terms of radius difference).

Also, the spark plug 100 employs the provision that a shortest distance L between the outer surface 14 of the isolation portion P of the insulator 10 and a dihedral angle region W defined by the front end surface 57 of the metallic shell 50 and the wall surface 59 of the cylindrical hole 55 of the metallic shell 50 be greater than a size G of the spark discharge gap GAP. A dihedral angle region is known to be the location where the electric field strength increases, and is thus known to be apt to serve as a starting point of spark discharge. The generation of spark discharge between the dihedral angle region W and the center electrode 20 requires the generation of aerial discharge between the dihedral angle region W and the isolation portion P and the generation of creeping discharge between the center electrode 20 and the starting point of aerial discharge on the outer surface 14 of the isolation portion P. When the shortest distance L between the dihedral angle region W and the isolation portion P is greater than the spark discharge gap GAP, an insulation resistance between the dihedral angle region W and the center electrode 20 is unlikely to become lower than an insulation resistance across the spark discharge gap GAP. Thus, in the course of operation of an engine, a spark discharge can be more reliably generated across the regular spark discharge gap GAP.

Also, the spark plug 100 employs the provision that a smallest thickness T of the isolation portion P of the insulator 10 as measured in the radial direction of the spark plug 100 be 0.5 mm or greater. In order to, as mentioned above, increase the surface area S of the outer surface 14 of the isolation portion P of the insulator 10 while limiting the approach of the isolation portion P to the wall surface 59 of the cylindrical hole 55 of the metallic shell 50, it is conceived to partially reduce the thickness of the insulator 10. However, the following problem is involved in fabrication of the insulator 10 composed of the steps of compacting an insulation powder, such as an alumina powder, forming the resultant green compact into a predetermined shape through cutting, and firing the formed green compact. Since the insulator 10 has the axial hole 12, a reduction in the radial thickness may lead to deterioration in yield due to breakage or the like in the forming step. Particularly, because of impartment of unevenness to the isolation portion P, the smallest thickness T of the isolation portion P of the insulator 10 tends to reduce. In order to prevent this problem, according to Example 4 to be described later, the smallest thickness T of the isolation portion P of the insulator 10 is desirably 0.5 mm or greater for ensuring sufficient thickness for the insulator 10.

Through employment of the above-mentioned provisions, even in a state in which the pressure in a combustion chamber is increased above a conventional level, the generation of creeping discharge along the isolation portion P can be sufficiently prevented. However, in order to provide the spark plug 100 capable of coping with a further increase in pressure in a combustion chamber above a target level considered in relation to the above-mentioned provisions, the present embodiment further employs the following provision.

First, it is good practice for the front end portion P3 of the insulator 10 to project frontward in the direction of the axis O from the front end surface 57 of the metallic shell 50 by a projecting length N of 1.0 mm or greater. As mentioned above, by means of rendering the shortest distance L between the dihedral angle region W of the metallic shell 50 and the outer surface 14 of the insulator 10 greater than the size G of the spark discharge gap GAP, the generation of spark discharge across the regular spark discharge gap GAP can be ensured. In the case where the voltage applied between the electrodes is increased in association with a further increase in pressure in a combustion chamber, creeping discharge may be generated between the center electrode 20 and a starting point, on the outer surface 14 of the isolation portion P, of aerial discharge generated between the dihedral angle region W and the isolation portion P. In order to suppress the generation of such creeping discharge, an insulation distance between the center electrode 20 and a region from which creeping discharge would start must be increased. Example 5 to be described later has revealed that, by means of the front end portion P3 of the insulator 10 projecting frontward in the direction of the axis O from the front end surface 57 of the metallic shell 50 by a projecting length N of 1.0 mm or greater, an insulation resistance between the center electrode 20 and the metallic shell 50 can be further increased. Of course, even when the projecting length N is less than 1.0 mm, an insulation resistance of a practically usable range can be achieved. However, through employment of the above-mentioned range of the projecting length N, the insulation resistance between the dihedral angle region W and the center electrode 20 can be further increased. Accordingly, when the spark plug 100 is used in an engine whose output is further enhanced, the spark plug 100 can exhibit sufficient insulation performance, so that the generation of lateral sparks can be effectively prevented. On the other hand, an increase in the projecting length N accompanies an increase in the amount of heat which the front end portion P3 receives from a combustion chamber, resulting in an increase in temperature. Thus, the projecting length N is preferably 4.3 mm or less, more preferably 4.0 mm or less. As mentioned previously, the front end portion P3 assumes a cylindrical shape. Preferably, while having substantially the same outside diameter, the front end portion P3 extends in the direction of the axis O beyond the position of the front end surface 57 of the metallic shell 50; i.e., the position of the dihedral angle region W coincides with the position of an intermediate part of the front end portion P3 along the direction of the axis O. Through employment of this positional relation, an insulation distance between the dihedral angle region W and the outer surface 14 of the front end portion P3 of the insulator 10 (an insulation distance against a potential aerial discharge therebetween) can be ensured, whereby the generation of lateral sparks can be prevented.

In a process of manufacturing the spark plug 100, a dihedral angle portion defined by the front end surface 61 of the front end portion P3 of the insulator 10 and the outer side surface of the front end portion P3 may be apt to be chipped. In order to prevent such chipping, the dihedral angle portion may be rounded, and it is good practice to employ a radiusing dimension K of 0.1 mm or greater. According to Example 8 to be described later, when the radiusing dimension K is less than 0.1 mm, in a process of manufacturing the spark plug 100, the dihedral angle portion may be chipped. Nevertheless, the greater the radiusing dimension K, the shorter the insulation distance at the rounded portion. Thus, the radiusing dimension K is preferably 0.45 mm or less, more preferably 0.40 mm or less.

Also, at the front end portion P3, a gap M in the radial direction of 0.05 mm or greater may be provided between the center electrode 20 and the wall surface of the axial hole 12 of the insulator 10. Specifically, as shown in FIG. 2, the gap M may be formed by means of rendering the diameter of the front end portion 22 of the center electrode 20 smaller than that of a portion of the center electrode 20 located rearward of the front end portion 22 by 0.05 mm or greater in terms of radius difference. Of course, the gap M may be formed such that the diameter of the axial hole 12 of the insulator 10 at the front end portion P3 is greater than that at a portion other than the front end portion P3 by 0.05 mm or greater in terms of radius difference. Alternatively, the gap M of the above-mentioned size may be formed by means of working on both of the center electrode 20 and the insulator 10. The formation of the gap M can further elongate the insulation distance between the center electrode 20 and the metallic shell 50 via the isolation portion P. According to Example 6 to be described later, when the gap M is less than 0.05 mm, an insulation effect of an air layer in the gap M is weakened; consequently, insulation resistance across the isolation portion P lowers, even though the lowered insulation resistance is still sufficient for practical use. When the gap M is excessively large, the front end portion P3 encounters difficulty in releasing heat received from a combustion chamber toward the center electrode 20, potentially resulting in a drop in heat value. The gap M is preferably 0.47 mm or less for practical use, more preferably 0.45 mm or less.

In order to ensure an insulation distance at the front end portion P3, as mentioned previously, it is good practice to provide for the ratio (S/V) of the surface area S of the front end portion P3 of the insulator 10 to the volume V of the front end portion P3 of the insulator 10. Specifically, the provision that S/V satisfy the relation $1.40\ mm^{-1} \leqq S/V \leqq 2.00\ mm^{-1}$ is employed. According to Example 7 to be described later, even when S/V at the front end portion P3 is less than $1.40\ mm^{-1}$, a sufficient insulation distance for practical use can be ensured. However, in order to ensure an insulation distance at the front end portion P3 even in a state in which high voltage is required, an S/V of the front end portion P3 of $1.40\ mm^{-1}$ or greater is preferred. When the S/V of the front end portion P3 increases, the amount of heat received at the front end portion P3 from a combustion chamber increases, leading to an increase in temperature of the center electrode 20. Thus, the S/V of the front end portion P3 is preferably $2.25\ mm^{-1}$ or less, more preferably $2.00\ mm^{-1}$ or less.

Figure 3:
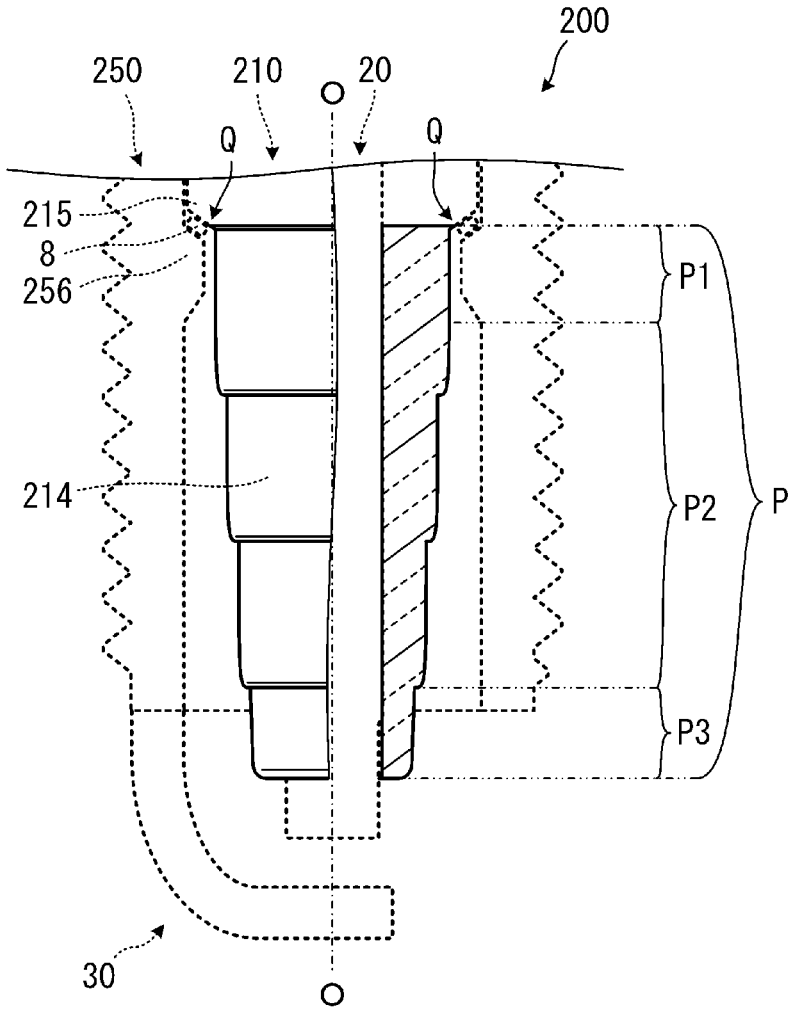
FIG. 3 Enlarged partially sectional view of the isolation portion P of a spark plug 200 according to a modification.

Needless to say, the present invention can be modified in various forms. For example, as in the case of a spark plug 200 shown in FIG. 3, the isolation portion P (intermediate portion P2) of an insulator 210 may be formed into a multistep shape for increasing the surface area S of an outer surface 214 of the isolation portion P of the insulator 210 such that the ratio (S/V) of the surface area S of the isolation portion P to the volume V of the isolation portion P is $1.26\ mm^{-1}$ to $1.40\ mm^{-1}$. Similar to the present embodiment, in an area where a holding portion 256 of a metallic shell 250 is in indirect contact with a stepped portion 215 of the insulator 210 via the sheet packing 8, a position located most frontward is called the position Q; a portion of the insulator 210 located frontward of the position Q and adapted to electrically insulatively isolate the center electrode 20 and the holding portion 256 from each other is called the isolation portion P (represented by the solid line in FIG. 3); and various provisions are made for the isolation portion P and the front end portion P3.

Figure 4:
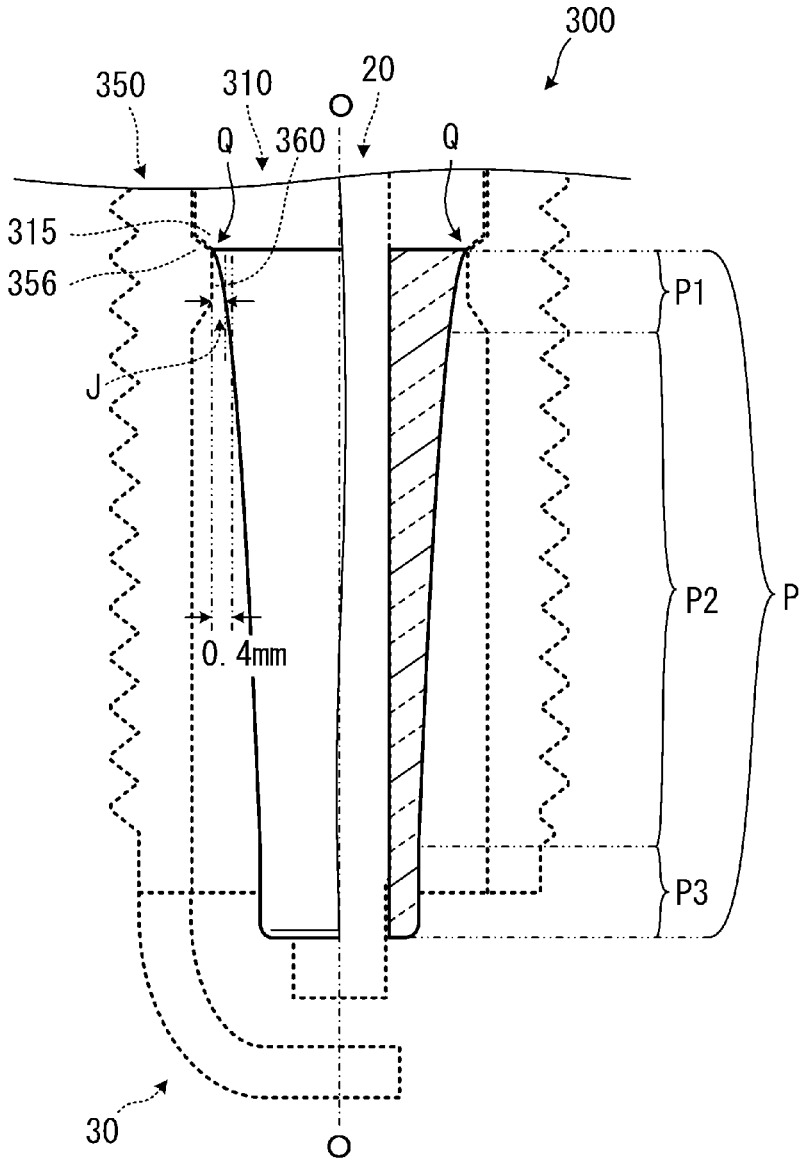
FIG. 4 Enlarged partially sectional view of the isolation portion P of a spark plug 300 according to another modification.

Also, as in the case of a spark plug 300 shown in FIG. 4, the proximal end portion P1 and the intermediate portion P2 of the isolation portion P of an insulator 310 may be reduced in radial thickness while being extended in the direction of the axis O, such that the ratio (S/V) of the surface area S of an outer surface 340 of the isolation portion P (represented by the solid line in FIG. 4) of the insulator 310 to the volume V of the isolation portion P of the insulator 310 is $1.26\ mm^{-1}$ to $1.40\ mm^{-1}$. That is, an insulation distance against creeping discharge is elongated through extension of the isolation portion P in the direction of the axis O, and the thickness is reduced whereby the amount of heat accumulated in the isolation portion P can be reduced. Thus, the spark plug 300 cannot be of a low heat value type. Notably, in the spark plug 300, packing is not provided between a holding portion 356 of a metallic shell 350 and a stepped portion 315 of the insulator 310; further, the proximal end portion P1 of the insulator 310 does not have a constant outside diameter. Even in this case, the gap J (herein, the greatest gap) between an inwardly oriented surface 360 of the holding portion 356 and the portion F of the proximal end portion P1 (a portion corresponding to the holding portion 356) which faces the inwardly oriented surface 360 may be 0.4 mm or less. Also, even in this case, similar to the above description, in an area where the holding portion 356 is in direct contact with the insulator 310, a position located most frontward is called the position Q; a portion of the insulator 310 located frontward of the position Q and adapted to electrically insulatively isolate the center electrode 20 and the holding portion 356 from each other is called the isolation portion P (represented by the solid line in FIG. 4); and various provisions are made for the isolation portion P and the front end portion P3.

Figure 5:
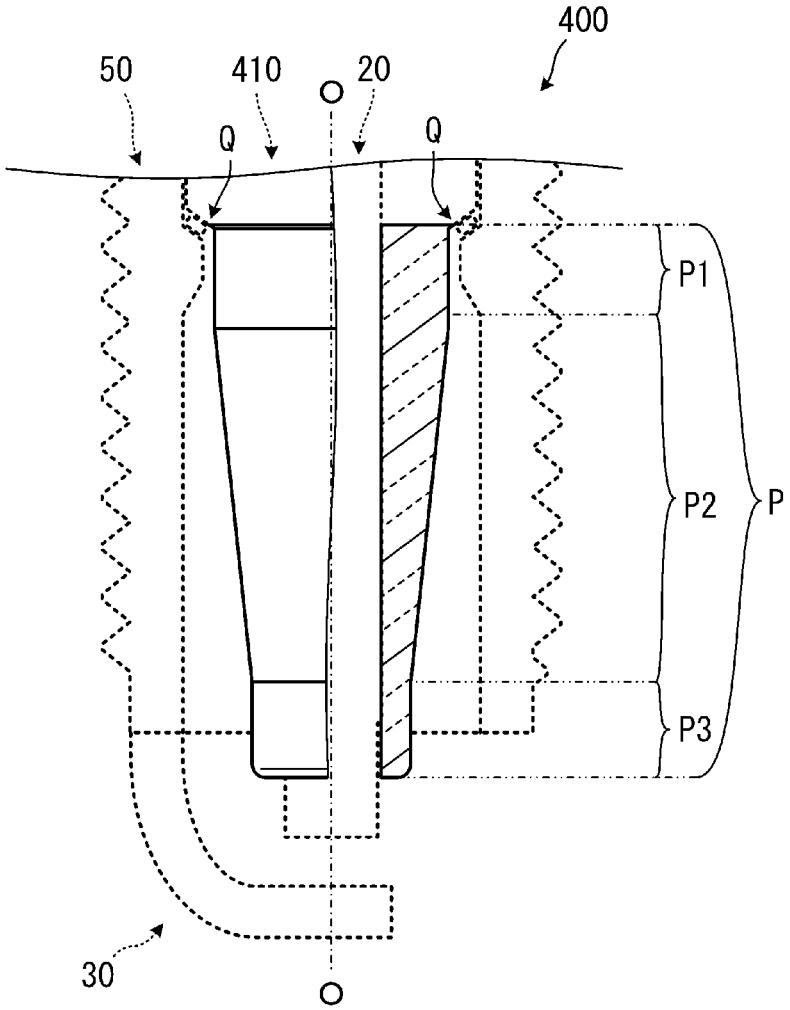
FIG. 5 Enlarged partially sectional view of the isolation portion P of a spark plug 400 according to another modification.
Figure 6:
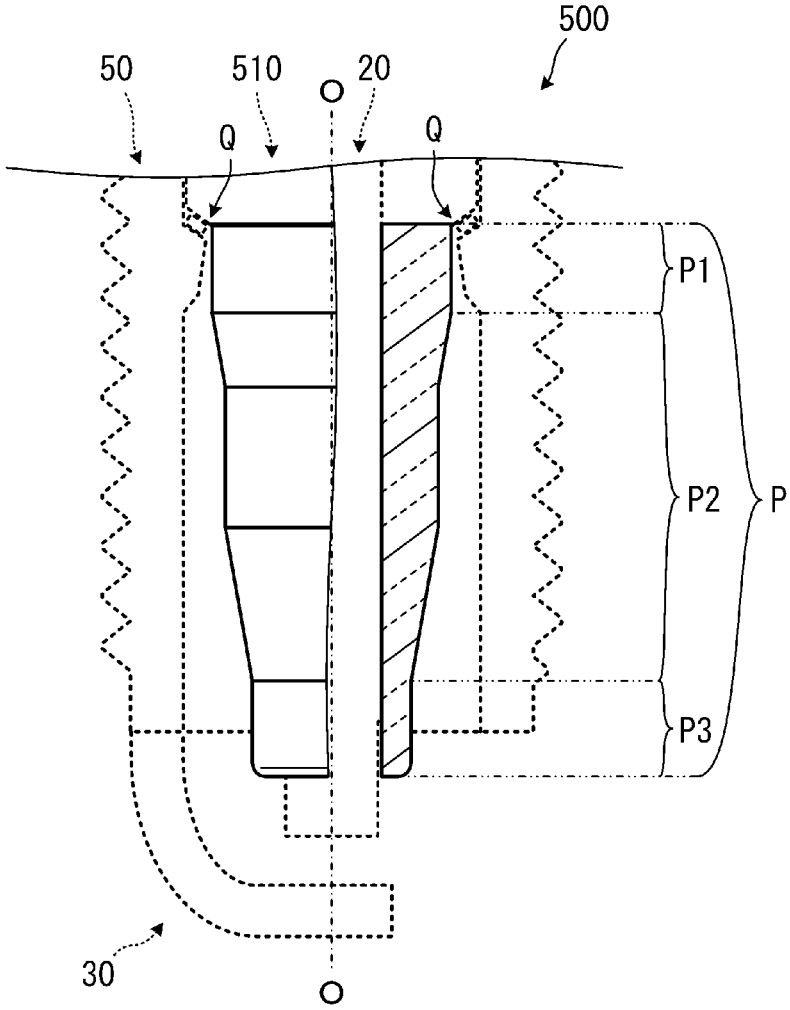
FIG. 6 Enlarged partially sectional view of the isolation portion P of a spark plug 500 according to another modification.

Also, as in the case of a spark plug 400 shown in FIG. 5, the intermediate portion P2 of the isolation portion P may be formed into a tapered shape such that the outside diameter gradually reduces from the proximal end portion P1 toward the front end portion P3. Further, as in the case of a spark plug 500 shown in FIG. 6, the intermediate portion P2 of the spark plug 500 may be formed into a multistep (herein, two-step) shape. Even in the spark plugs 400 and 500, similar to the present embodiment, various provisions are made for the isolation portion P and the front end portion P3.

In this manner, by means of employment of the above-mentioned various provisions in association with increase of the surface area S of the outer surface 14 of the isolation portion P of the insulator 10, while a heat value requirement of an engine is satisfied, the generation of creeping discharge on the isolation portion P can be restrained. Further, through employment of various provisions for the front end portion P3, insulation performance between the center electrode 20 and the metallic shell 50 via the isolation portion P can be further enhanced. Accordingly, an aerial discharge can be reliably generated across the regular spark discharge gap GAP.

EXAMPLE 1

Next, in order to verify the effect of the employment of the above-mentioned provisions, evaluation tests were conducted. First, an evaluation test was conducted in order to verify that, by means of increasing the ratio of the surface area S of the isolation portion P of the insulator to the volume V of the isolation portion P of the insulator, even in use with an engine whose output is higher than a conventional level (i.e., an engine having high combustion pressure), a sufficient insulation distance can be ensured between the center electrode and the metallic shell.

In this evaluation test, insulators which could be substituted for insulators of conventional spark plugs having heat value No. 6 and M12 in the nominal size of threads of the metallic shell were fabricated as follows. Insulators of seven types, three pieces each, different in the shape of the outer surface of the leg portion (more specifically, the intermediate portion P2 of the isolation portion P) were prepared. All of the insulators had a length in the direction of the axis O of the leg portion of 15 mm. The surface area S of the outer surface of the isolation portion P and the volume V of the isolation portion P were calculated from the designed dimensions of these insulators. Then, the ratio (S/V) of the surface area S to the volume V was calculated. The ratios obtained from the calculation were 1.07 $mm^{-1}$, 1.13 $mm^{-1}$, 1.20 $mm^{-1}$, 1.24 $mm^{-1}$, 1.26 $mm^{-1}$, 1.30 $mm^{-1}$, and 1.33 $mm^{-1}$. By use of the above-mentioned 21 insulators of seven types, spark plug samples were fabricated. For a running test, the spark plug samples were attached to a 2000 cc piston-displacement, straight 4-cylinder, DOHC, direct-injection-type engine which required a spark plug to have heat value No. 6. The running test was conducted such that a test run pattern was repeated by five cycles. One cycle of test run pattern is as follows: the engine to which the spark plug samples were attached was started in a state in which the ambient temperature, the water temperature, and the oil temperature were −20° C.; the running speed was accelerated and decelerated 10 times between 10 km/h and 20 km/h; and then running was stopped.

Figure 7:
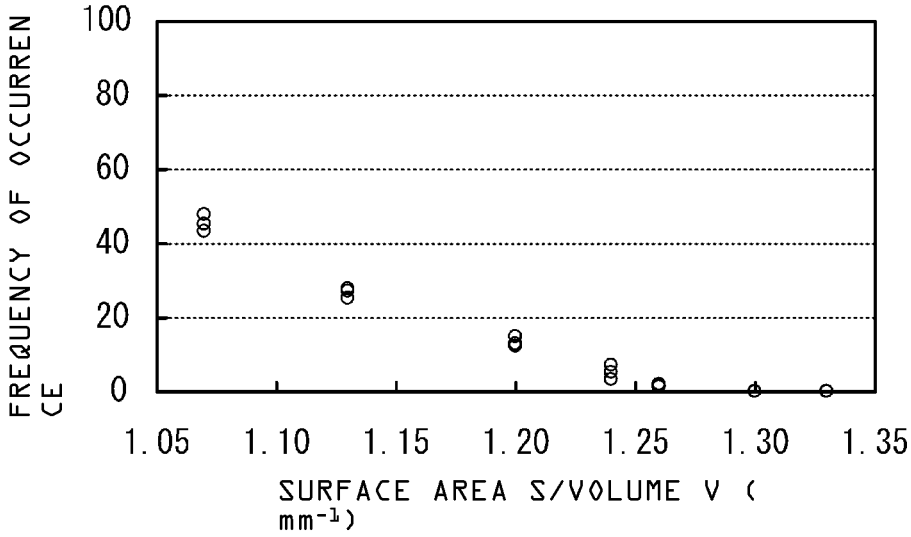
FIG. 7 Graph showing the interrelationship between the frequency of occurrence of creeping discharge and the ratio (S/V) of the surface area S of the isolation portion P of the insulator to the volume V of the isolation portion P of the insulator.
Figure 8:
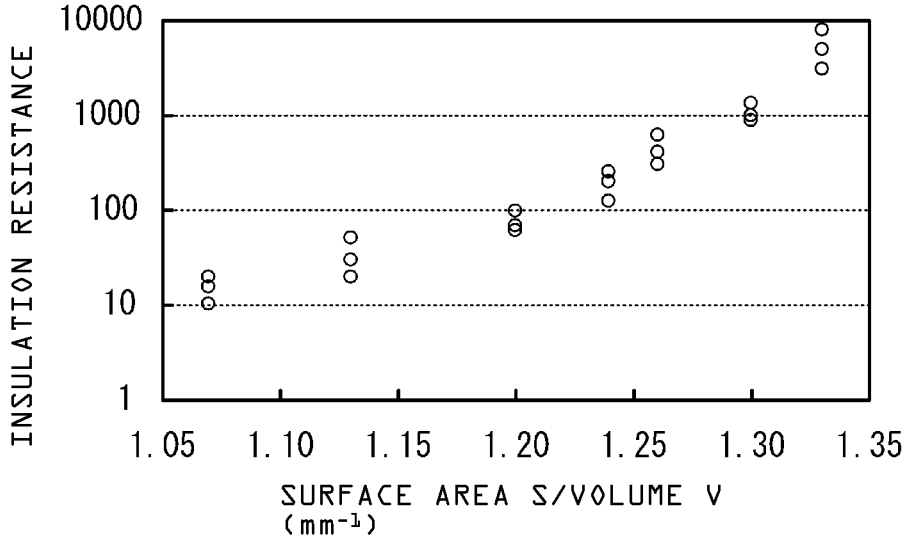
FIG. 8 Semilogarithmic graph showing the interrelationship between insulation resistance across the isolation portion P and the ratio (S/V) of the surface area S of the isolation portion P of the insulator to the volume V of the isolation portion P of the insulator.

The samples were evaluated for the frequency of occurrence of creeping discharge during the running test and insulation resistance across the isolation portion P after the running test. Specifically, discharge waveforms during the running test were observed. Discharge waveforms corresponding to 100 arbitrary discharges were sampled. Among the sampled discharge waveforms, discharge waveforms indicative of flashover associated with creeping discharge were identified, and the number of occurrences of such a discharge waveform was counted, whereby the frequency of occurrence (incidence) of creeping discharge was obtained. Further, after the running test, in a state in which an insulant was placed in the regular spark discharge gap GAP of each of the samples, high voltage was applied between the center electrode and the metallic shell, and insulation resistance against creeping discharge was measured. FIG. 7 shows the results of evaluation of the interrelationship between the frequency of occurrence of creeping discharge during the running test and the ratio (S/V) of the surface area S of the isolation portion P of the insulator to the volume V of the isolation portion P of the insulator. FIG. 8 shows the results of evaluation of the interrelationship between insulation resistance across the isolation portion P and the ratio (S/V) of the surface area S of the isolation portion P of the insulator to the volume V of the isolation portion P of the insulator.

As shown in FIG. 7, the following tendency was observed: as the ratio (S/V) of the surface area S of the isolation portion P of the insulator to the volume V of the isolation portion P of the insulator increases, the frequency of occurrence of creeping discharge lowers. At an S/V of 1.26 $mm^{-1}$ or higher, the frequency of occurrence of creeping discharge was 2% or less. As shown in FIG. 8, the following tendency was observed: as S/V increases, insulation resistance across the isolation portion P increases logarithmically. Generally, when the insulation resistance is on the order of tens of MΩ, the generation of creeping discharge between the center electrode and the metallic shell can be restrained, and an S/V of 1.20 $mm^{-1}$ or higher suffices. However, when S/V is 1.24 $mm^{-1}$ or higher, the insulation resistance becomes 100 MΩ or greater, indicating that an S/V of 1.24 $mm^{-1}$ or higher is desirable in view of more reliable prevention of creeping discharge. Thus, it has been confirmed from the above that, through employment of an S/V of 1.26 $mm^{-1}$ or higher, a creeping discharge can be more reliably prevented.

EXAMPLE 2

Figure 9:
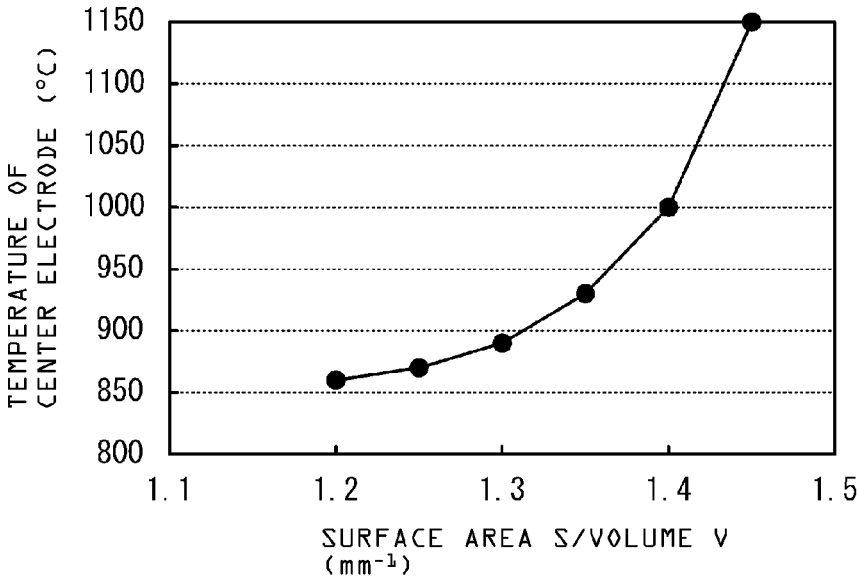
FIG. 9 Graph showing the interrelationship between the temperature of a front end portion of a center electrode and the ratio (S/V) of the surface area S of the isolation portion P of the insulator to the volume V of the isolation portion P of the insulator.

Next, an evaluation test was conducted in order to confirm the upper limit of the ratio of the surface area S of the isolation portion P of the insulator 10 to the volume V of the isolation portion P of the insulator 10. Similar to Example 1, insulators of six types were fabricated such that the shape of the outer surface of the leg portion (the intermediate portion P2 of the isolation portion P) was varied so as to vary the ratio (S/V) of the surface area S of the isolation portion P to the volume V of the isolation portion P in a range from 1.20 $mm^{-1}$ to 1.45 $mm^{-1}$ at intervals of 0.05 $mm^{-1}$. Spark plug samples were prepared as follows: the thus-fabricated insulators were substituted for insulators of conventional spark plugs having heat value No. 6 and M12 in the nominal size of threads of the metallic shell. All of the insulators had a length in the direction of the axis O of the leg portion of 15 mm. The samples were attached to aluminum bushes formed by use of an aluminum material similar to that used to form an engine head, and having an water cooling mechanism through which cooling water of 25° C. was circulated. The samples were heated from the front end side in the direction of the axis O by a perpendicularly oriented propane burner, and the temperature of the front end portions of the center electrodes were measured. FIG. 9 shows the results of evaluation of the interrelationship between the temperature of a front end portion of the center electrode and the ratio (S/V) of the surface area S of the isolation portion P of the insulator to the volume V of the isolation portion P of the insulator.

As shown in FIG. 9, the following was confirmed: as S/V increases, the amount of heat received increases, and the temperature of the front end portion of the center electrode increases. Also, the following was revealed: when S/V exceeds 1.40 $mm^{-1}$, the temperature of the front end portion of the center electrode exceeds 1,000° C.; as a result, preignition or the like is apt to occur, and thus a spark plug of a higher heat value type (cold type) must be used.

EXAMPLE 3

Next, an evaluation test was conducted in order to confirm a preference for the following: the shortest distance L between the dihedral angle region W defined by the front end surface and the wall surface of the cylindrical hole of the metallic shell and the outer surface of the isolation portion P of the insulator is greater than the size G of the spark discharge gap GAP. In this evaluation test, similar to Example 1, insulators of four types were fabricated such that the shape of the outer surface of the leg portion (the intermediate portion P2 of the isolation portion P) was varied so as to have a shortest distance L between the dihedral angle region W of the metallic shell and the outer surface of the isolation portion P of the insulator of 1.0 mm, 1.1 mm, 1.2 mm, and 1.3 mm. The thus-fabricated insulators were substituted for insulators of conventional spark plugs having heat value No. 6 and M12 in the nominal size of threads of the metallic shell, thereby preparing spark plug samples 11 to 14 in the order of the above-mentioned shortest distances L. The samples were adjusted to 1.1 mm in the size G of the spark discharge gap GAP. The samples were attached to a pressure chamber; the chamber was filled with an inert gas; the inner pressure of the pressure chamber was adjusted to 1 MPa; and a spark discharge was generated 500 times. The images of the spark discharges were captured. Among the 500 spark discharges, the number of spark discharges between the dihedral angle region W of the metallic shell and the outer surface of the isolation portion P of the insulator (so-called lateral sparks) with a failure of the generation of spark discharge across the regular spark discharge gap GAP was counted. Table 1 shows the results of this evaluation test.

TABLE 1

| Sample | Shortest distance L [mm] | Number of occurrences of lateral sparks | Judgment |
|---|---|---|---|
| 11 | 1.0 | 8 or more | Failure |
| 12 | 1.1 | 3 to 7 | Failure |
| 13 | 1.2 | 2 or less | Fair |
| 14 | 1.3 | 0 | Excellent |

As shown in Table 1, in samples 11 and 12, in which the shortest distance L between the dihedral angle region W of the metallic shell and the outer surface of the isolation portion P of the insulator was equal to or less than the size G of the spark discharge gap GAP (1.1 mm or less), the 500 spark discharges involved three or more occurrences of lateral sparks, and, as the shortest distance L reduced, the number of occurrences of lateral sparks increased. Thus, samples 11 and 12 were evaluated as "Failure." In sample 13, in which the shortest distance L was 1.2 mm, which was greater than the size G of the spark discharge GAP (1.1 mm), the 500 spark discharges involved two or less occurrences of lateral sparks. Although the generation of lateral sparks is not completely prevented, the number of occurrences of lateral sparks does not raise any problem in practical use. Thus, sample 13 was evaluated as "Fair." In sample 14, in which the shortest distance L was 1.3 mm, lateral sparks were not generated. Thus, sample 14 was evaluated as "Excellent." The results of the evaluation test have revealed that, by means of rendering the shortest distance L between the dihedral angle region W of the metallic shell and the outer surface of the isolation portion P of the insulator greater than the spark discharge gap GAP, even when electric fields concentrate on the dihedral angle region W, the generation of lateral sparks can be sufficiently restrained, so that a spark discharge can be generated across the regular spark discharge gap GAP.

EXAMPLE 4

Figure 10:
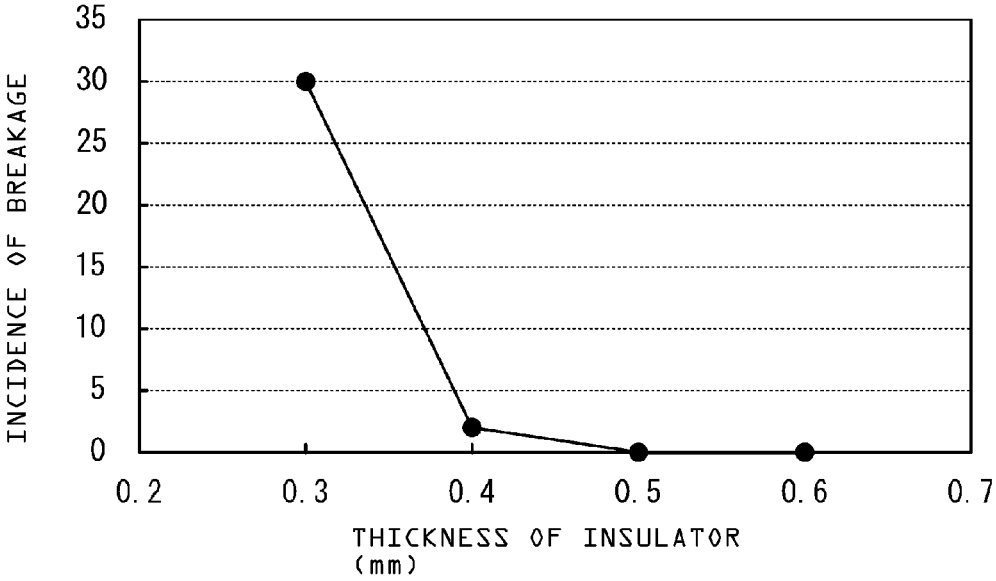
FIG. 10 Graph showing the interrelationship between the smallest thickness T of the isolation portion P of the insulator and the incidence of breakage in the process of manufacturing insulators.

Next, an evaluation test was conducted in order to confirm a preference for the following: the smallest thickness T of the isolation portion P of the insulator is 0.5 mm or greater. Similar to Example 1, insulators which could be substituted for insulators of conventional spark plugs having M12 in the nominal size of threads of the metallic shell were designed as follows. Insulators of four types were designed such that the shape of the outer surface of the leg portion (the intermediate portion P2 of the isolation portion P) was varied so as to have a smallest thickness T of the isolation portion P of 0.3 mm, 0.4 mm, 0.5 mm, and 0.6 mm. In the process of fabrication of the thus-designed insulators, the ratio of occurrence of defect such as breakage (the incidence of breakage in 100 samples fabricated for each of the smallest thicknesses T) was obtained. Specifically, in the process of fabrication of the insulators, a defect, such as breakage, may arise during cutting work to be performed after compaction of an insulation powder, such as an alumina powder. FIG. 10 shows the results of this evaluation test.

As shown in FIG. 10, when the smallest thickness T of the isolation portion P was 0.3 mm, the incidence of breakage was 30%; at a smallest thickness T of 0.4 mm, the incidence reduced to 2%; and at a smallest thickness T of 0.5 mm or greater, breakage did not occur. The results of the evaluation test have revealed that a smallest thickness T of the isolation portion P of the insulator of 0.5 mm or greater is preferred.

EXAMPLE 5

Next, an evaluation test was conducted for the projecting length N by which the front end portion P3 of the isolation portion P projected from the front end surface of the metallic shell. In this evaluation test, there were prepared four insulators which could be substituted for insulators of conventional spark plugs having M12 in the nominal size of threads of the metallic shell and in which the intermediate portion P2 was tapered such that the outside diameter thereof gradually reduced from the proximal end portion P1 toward the front end portion P3. For fabrication of the insulators, the insulators were designed as follows. The outside diameter of the proximal end portion P1 was adjusted such that, when each insulator was assembled into a spark plug, a gap J of 0.4 mm was formed between the inwardly oriented surface of the holding portion of the metallic shell and the outer circumferential surface of the proximal end portion P1. The taper angle of the intermediate portion P2 was adjusted such that the S/V ratio of the isolation portion P became 1.26 $mm^{-1}$. Adjustment was made to have a radiusing dimension K of 0.4 mm for radiusing on the front end portion P3. Also, the metallic shells and the center electrodes for use in the present evaluation test were fabricated. The metallic shells of four types were prepared such that the position of the rearwardly oriented surface of the holding portion in the direction of the axis O was adjusted. Four center electrodes were prepared such that the diameter of a front end portion to be disposed within the axial hole of the front end portion P3 of the insulator after assembly into the insulator was smaller than that of a portion located rearward of the front end portion by 0.05 mm in terms of radius difference. By use of these insulators, metallic shells, and center electrodes, spark plugs were assembled, thereby completing spark plug samples of four types having a projecting length N of the front end portion P3 of the insulator from the front end surface of the metallic shell of 0.8 mm, 1.0 mm, 4.0 mm, and 4.3 mm. The spark plug samples were sequentially called samples 21 to 24.

In a state in which an insulant was placed in the regular spark discharge gap GAP of each of the samples, high voltage was applied between the center electrode and the metallic shell, and insulation resistance against creeping discharge across the isolation portion P was measured. Further, the samples were attached to aluminum bushes formed by use of an aluminum material similar to that used to form an engine head, and having an water cooling mechanism through which cooling water of 25° C. was circulated. The samples were heated from the front end side in the direction of the axis O by a perpendicularly oriented propane burner, and the temperature of the front end portions of the center electrodes were measured. Table 2 shows the results of the measurements.

TABLE 2

| Sample | 21 | 22 | 23 | 24 |
|---|---|---|---|---|
| Gap J [mm] | 0.4 | | | |
| S/V ratio of isolation portion P [$mm^{-1}$] | 1.26 | | | |
| Projecting length N of front end portion P3 [mm] | 0.8 | 1.0 | 4.0 | 4.3 |
| Radiusing dimension K [mm] | 0.4 | | | |
| Gap M of center electrode [mm] | 0.05 | | | |
| Insulation resistance [MΩ] | 200 | 300 | 320 | 320 |
| Temperature of center electrode [° C.] | 875 | 875 | 940 | 980 |

As mentioned previously, when the insulation resistance is on the order of tens of MΩ, the generation of creeping discharge between the center electrode and the metallic shell can be restrained; further, an insulation resistance of 100 MΩ or higher is desirable in view of more reliable prevention of creeping discharge. Additionally, for use in an engine having far higher output, far higher insulation resistance is required; specifically, an insulation resistance of 250 MΩ or higher is desirable. As shown in Table 2, sample 21 having a projecting length N of the front end portion P3 of 0.8 mm provides an insulation resistance sufficient for practical use. However, it has been revealed that samples 22 to 24 having a projecting length N of the front end portion P3 of 1.0 mm or greater provide more desirable insulation resistances.

Generally, when the temperature of the center electrode is restrained to 1,000° C. or lower, a heat value requirement (heat value No. 6) equivalent to that for a conventional spark plug is said to be satisfied. For use in an engine having far higher output, a higher heat value is required; thus, the temperature of the center electrode is desirably 950° C. or lower. As shown in Table 2, sample 24 having a projecting length N of the front end portion P3 of 4.3 mm can ensure a temperature of the center electrode of 1,000° C. or lower acceptable for practical use. However, it has been revealed that samples 21 to 23 capable of ensuring a temperature of the center electrode of 950° C. or lower and having a projecting length N of the front end portion P3 of 4.0 mm or less can provide more desirable heat values.

Thus, the results of the evaluation test have revealed that samples 22 and 23, which can ensure an insulation resistance of 250 MΩ or greater and a temperature of the center electrode of 950° C. or lower, are sufficiently usable with an engine having far higher output. Therefore, a projecting length N of the front end portion P3 of 1.0 mm or greater is preferred.

EXAMPLE 6

Next, an evaluation test was conducted for the size of the gap M between the center electrode and the wall surface of the axial hole of the insulator as measured at the front end portion P3 of the isolation portion P. In this evaluation test, four insulators having dimensional conditions similar to those of Example 5 were prepared. Center electrodes of four types were prepared such that the diameter of a front end portion to be disposed within the axial hole of the front end portion P3 of the insulator after assembly into the insulator was varied differently from that of a portion located rearward of the front end portion. By use of these insulators and center electrodes, spark plugs were assembled, thereby completing spark plug samples of four types having a gap M of 0.03 mm, 0.05 mm, 0.45 mm, and 0.47 mm. The spark plug samples were sequentially called samples 31 to 34. The samples underwent the evaluation test similar to that of Example 5 and were measured for the insulation resistance and the temperature of the front end portions of the center electrodes. Table 3 shows the results of the measurements.

TABLE 3

| Sample | 31 | 32 | 33 | 34 |
|---|---|---|---|---|
| Gap J [mm] | 0.4 | | | |
| S/V ratio of isolation portion P [$mm^{-1}$] | 1.26 | | | |
| Projecting length N of front end portion P3 [mm] | 1.0 | | | |
| Radiusing dimension K [mm] | 0.4 | | | |
| Gap M of center electrode [mm] | 0.03 | 0.05 | 0.45 | 0.47 |
| Insulation resistance [MΩ] | 170 | 300 | 370 | 380 |
| Temperature of center electrode [° C.] | 875 | 875 | 950 | 990 |

As shown in Table 3, sample 31 having a gap M of the center electrode of 0.03 mm provides an insulation resistance acceptable for practical use (100 MΩ or greater). However, it has been revealed that samples 32 to 34 having a gap M of the center electrode of 0.05 mm or greater provide more desirable insulation resistances (250 MΩ or greater). Meanwhile, sample 34 having a gap M of the center electrode of 0.47 mm can ensure a temperature of the center electrode of 1,000° C. or lower acceptable for practical use. However, it has been revealed that samples 31 to 33 having a gap M of the center electrode of 0.45 mm or less can ensure a temperature of the center electrode of 950° C. or lower and thus can provide more desirable heat values. Thus, the results of the evaluation test have revealed that samples 32 and 33, which can ensure an insulation resistance of 250 MΩ or greater and a temperature of the center electrode of 950° C. or lower, are sufficiently usable with an engine having far higher output. Therefore, a gap M of the center electrode (difference in diameter represented by radial difference) of 0.05 mm or greater is preferred.

EXAMPLE 7

Next, an evaluation test was conducted for the ratio (S/V) of the surface area S of the front end portion P3 of the isolation portion P to the volume V of the front end portion P3 of the isolation portion P. In this evaluation test, insulators of five types were designed as follows and fabricated according to the designed dimensions: the S/V of the isolation portion P was 1.26 $mm^{-1}$; the projecting length N of the front end portion P3 was 1.0 mm; the radiusing dimension K was 0.4 mm; the outside diameter of the proximal end portion P1 was adjusted such that, when each insulator was assembled into the metallic shell, a gap J of 0.4 mm or less was formed between the proximal end portion P1 and the holding portion; and the taper angle of the intermediate portion P2, the axial lengths of the proximal end portion P1, the intermediate portion P2, and the front end portion P3, etc. were adjusted such that the S/V of the front end portion P3 was appropriately set in a range from 1.35 $mm^{-1}$ to 2.25 $mm^{-1}$. Five center electrodes were prepared as follows: the diameter of a front end portion of each of the center electrodes was adjusted such that, when each center electrode was assembled into the insulator, a gap M of 0.05 mm was formed between the front end portion and the wall surface of the axial hole of the insulator.

By use of these insulators and center electrodes, spark plugs were assembled, thereby completing spark plug samples of five types having an S/V of the front end portion P3 of 1.35 $mm^{-1}$, 1.40 $mm^{-1}$, 1.60 $mm^{-1}$, 2.00 $mm^{-1}$, and 2.25 $mm^{-1}$. The spark plug samples were sequentially called samples 41 to 45. The samples underwent the evaluation test similar to that of Example 5 and were measured for the insulation resistance, and the temperature of the front end portions of the center electrodes. Table 4 shows the results of the measurements.

TABLE 4

| Sample | 41 | 42 | 43 | 44 | 45 |
|---|---|---|---|---|---|
| Gap J [mm] | 0.4 | | | | |
| S/V ratio of isolation portion P [$mm^{-1}$] | 1.26 | | | | |
| S/V ratio of front end portion P3 [$mm^{-1}$] | 1.35 | 1.40 | 1.60 | 2.00 | 2.25 |
| Projecting length N of front end portion P3 [mm] | 1.0 | | | | |
| Radiusing dimension K [mm] | 0.4 | | | | |
| Gap M of center electrode [mm] | 0.05 | | | | |
| Insulation resistance [MΩ] | 230 | 280 | 300 | 370 | 380 |
| Temperature of center electrode [° C.] | 860 | 860 | 875 | 920 | 960 |

As shown in Table 4, sample 41 having an S/V of the front end portion P3 of 1.35 $mm^{-1}$ provides an insulation resistance acceptable for practical use (100 MΩ or greater). However, it has been revealed that samples 42 to 45 having an S/V of 1.40 $mm^{-1}$ or greater provide more desirable insulation resistances (250 MΩ or greater). Meanwhile, sample 45 having an S/V of the front end portion P3 of 2.25 $mm^{-1}$ can ensure a temperature of the center electrode of 1,000° C. or lower acceptable for practical use. However, it has been revealed that samples 41 to 44 having an S/V of the front end portion P3 of 2.00 $mm^{-1}$ or lower can ensure a temperature of the center electrode of 950° C. or lower and thus can provide more desirable heat values. Thus, the results of the evaluation test have revealed that samples 42 to 44, which can ensure an insulation resistance of 250 MΩ or greater and a temperature of the center electrode of 950° C. or lower, are sufficiently usable with an engine having far higher output. Therefore, an S/V of the front end portion P3 of 1.40 $mm^{-1}$ to 2.00 $mm^{-1}$ is preferred.

EXAMPLE 8

Next, an evaluation test was conducted for the radiusing dimension K for radiusing on the front end portion P3 of the isolation portion P. In this evaluation test, insulators of four types were designed as follows and fabricated according to the designed dimensions: the S/V of the isolation portion P was 1.26 $mm^{-1}$; the projecting length N of the front end portion P3 was 1.0 mm; the outside diameter of the proximal end portion P1 was adjusted such that, when each insulator was assembled into the metallic shell, a gap J of 0.4 mm or less was formed between the proximal end portion P1 and the holding portion; and the radiusing dimension K of the front end portion P3 was appropriately set in a range from 0.05 mm to 0.45 mm. Four center electrodes were prepared as follows: the diameter of a front end portion of each of the center electrodes was adjusted such that, when each center electrode was assembled into the insulator, a gap M of 0.05 mm was formed between the front end portion and the wall surface of the axial hole of the insulator. By use of these insulators and center electrodes, spark plugs were assembled, thereby completing spark plug samples of four types having a radiusing dimension K of the front end portion P3 of 0.05 mm, 0.1 mm, 0.4 mm, and 0.45 mm. The spark plug samples were sequentially called samples 51 to 54. The samples underwent the evaluation test similar to that of Example 5 and were measured for the insulation resistance and the temperature of the front end portions of the center electrodes. Table 5 shows the results of the measurements.

TABLE 5

| Sample | 51 | 52 | 53 | 54 |
|---|---|---|---|---|
| Gap J [mm] | 0.4 | | | |
| S/V ratio of isolation portion P [$mm^{-1}$] | 1.26 | | | |
| Projecting length N of front end portion P3 [mm] | 1.0 | | | |
| Radiusing dimension K [mm] | 0.05 | 0.1 | 0.4 | 0.45 |
| Gap M of center electrode [mm] | 0.05 | | | |
| Insulation resistance [MΩ] | 320 | 320 | 300 | 230 |
| Temperature of center electrode [° C.] | 875 | 875 | 875 | 875 |
| Occurrence of chipping | Yes | No | No | No |

Mere adjustment of the radiusing dimension K does not have much effect on the thermal capacity of the front end portion P3. As shown in Table 5, all of the samples could ensure a temperature of the center electrode of 950° C. or lower. Meanwhile, sample 54 having a radiusing dimension K of 0.45 mm could provide an insulation resistance acceptable for practical use (100 MΩ or greater), but failed to provide a more preferable insulation resistance of 250 MΩ or greater. Samples 52 and 53 having a radiusing dimension K of from 0.1 mm to 0.4 mm could ensure an insulation resistance of 250 MΩ or greater. However, sample 51 having a radiusing dimension K of 0.05 mm could ensure an insulation resistance of 250 MΩ or greater, but suffered chipping in the process of manufacturing a spark plug. Thus, the results of the evaluation test have revealed that samples 52 and 53, which can ensure an insulation resistance of 250 MΩ or greater and a temperature of the center electrode of 950° C. or lower, are sufficiently usable with an engine having far higher output. Therefore, a radiusing dimension K of the front end portion P3 of 0.1 mm or greater is preferred.

The invention claimed is:

1. A spark plug comprising:

a center electrode;

an insulator having an axial hole extending in an axial direction of the center electrode, and holding the center electrode in a front end portion of the axial hole;

a metallic shell having a cylindrical hole extending in the axial direction, and having, within the cylindrical hole, a holding portion being in direct or indirect contact with an outer surface of the insulator along a whole circumference of the insulator and adapted to hold the insulator in the cylindrical hole; and a ground electrode whose one end portion is joined to the metallic shell and which is bent such that another end portion thereof faces a front end portion of the center electrode and defines a spark discharge gap in cooperation with the front end portion of the center electrode;

wherein, when a portion of the insulator located, in the axial direction, frontward of a position Q where, as viewed from a front side in the axial direction, the insulator first comes in direct or indirect contact with the holding portion is defined as an isolation portion, a portion of the outer surface of the isolation portion which faces an inwardly oriented surface which partially constitutes the holding portion and faces inward with respect to a radial direction orthogonal to the axial direction is disposed such that a gap of 0.4 mm or less in the radial direction is formed between the portion and the inwardly oriented surface along a whole circumference of the portion, a ratio (S/V) of a surface area S of the outer surface of the isolation portion of the insulator to a volume V of the isolation portion of the insulator satisfies a relation 1.26 $mm^{-1} \leqq S/V \leqq 1.40\ mm^{-1}$, and a greatest outside diameter of the isolation portion of the insulator is equal to or less than an outside diameter of the insulator as measured at the position Q.

2. A spark plug according to claim 1, wherein a front end portion in the axial direction of the isolation portion projects 1.0 mm or greater from a front end of the metallic shell; in the outer surface of the front end portion of the isolation portion, a dihedral angle portion defined by a front end surface and an outer side surface is rounded with a radiusing dimension of 0.4 mm or less; and a distance in the radial direction between the center electrode and a wall surface of the axial hole of the insulator as measured at the front end portion of the isolation portion is 0.05 mm or greater.

3. A spark plug according to claim 2, wherein the front end portion of the isolation portion assumes a cylindrical shape extending in the axial direction and is disposed in such a manner as to extend in the axial direction beyond a position of the front end of the metallic shell, and a ratio (S/V) of the surface area S of the front end portion of the isolation portion to the volume V of the front end portion of the isolation portion satisfies a relation $1.40\ mm^{-1} \leqq S/V \leqq 2.00\ mm^{-1}$.

4. A spark plug according to claim 1, wherein:

the metallic shell has an attachment portion formed on an outer circumference thereof and having threads for attaching the metallic shell to an internal combustion engine, and a nominal diameter of the threads is M8 to M12, and a shortest distance L in the radial direction between the outer surface of the isolation portion of the insulator and a dihedral angle portion defined by a front end surface of the metallic shell and a wall surface of the cylindrical hole of the metallic shell is greater than a size G of the spark discharge gap.

5. A spark plug according to claim 1, wherein a smallest thickness T of the isolation portion of the insulator as measured in the radial direction is 0.5 mm or greater.

* * * * *